US007694485B1

(12) United States Patent
Siener

(10) Patent No.: US 7,694,485 B1
(45) Date of Patent: Apr. 13, 2010

(54) MORTARLESS INTERLOCKING BUILDING BLOCK FOR A BUILDING BLOCK SYSTEM

(76) Inventor: Gregory Siener, 316 Carson Way, Paducah, KY (US) 42003

( * ) Notice: Subject to any disclaimer, the term of this patent is extended or adjusted under 35 U.S.C. 154(b) by 368 days.

(21) Appl. No.: 11/724,406

(22) Filed: Mar. 15, 2007

(51) Int. Cl.
*E04B 2/08* (2006.01)

(52) U.S. Cl. ..... 52/590.2; 52/606; 52/604; 52/605; 52/570; 52/592.6

(58) Field of Classification Search ..... 52/604, 52/606, 590.2, 58, 306, 570, 98, 592.1, 592.6
See application file for complete search history.

(56) References Cited

U.S. PATENT DOCUMENTS

| | | | | | |
|---|---|---|---|---|---|
| 868,838 | A | | 10/1907 | Brewington | |
| 900,753 | A | | 10/1908 | Mahler | |
| 2,012,024 | A | * | 8/1935 | Roberts | 52/592.1 |
| 2,684,589 | A | | 7/1954 | Perreton | |
| 3,382,632 | A | * | 5/1968 | Grofcsik | 52/223.7 |
| 3,873,225 | A | * | 3/1975 | Jakobsen et al. | 404/41 |
| 3,888,060 | A | | 6/1975 | Haener | |
| 4,031,678 | A | * | 6/1977 | Schuring | 52/570 |
| 4,107,894 | A | | 8/1978 | Mullins | |
| 4,115,980 | A | * | 9/1978 | Martel et al. | 52/590.2 |
| 4,640,071 | A | | 2/1987 | Haener | |
| 4,894,969 | A | * | 1/1990 | Horobin | 52/309.12 |
| 5,038,542 | A | * | 8/1991 | Kline | 52/306 |
| 5,125,867 | A | * | 6/1992 | Solomon | 446/488 |
| 5,365,714 | A | * | 11/1994 | Potvin | 52/590.2 |
| 5,402,609 | A | * | 4/1995 | Kelley, Jr. | 52/98 |
| 5,428,933 | A | * | 7/1995 | Philippe | 52/592.1 |
| 5,457,926 | A | * | 10/1995 | Jensen | 52/604 |
| 5,575,128 | A | | 11/1996 | Haener | |
| 5,899,040 | A | * | 5/1999 | Cerrato | 52/604 |
| 5,901,521 | A | | 5/1999 | Guy | |
| 5,934,039 | A | | 8/1999 | Guy | |
| 6,050,044 | A | | 4/2000 | McIntosh | |
| 6,053,661 | A | * | 4/2000 | Lewis | 405/36 |
| 6,226,951 | B1 | | 5/2001 | Azar | |
| 6,401,419 | B1 | * | 6/2002 | Beliveau | 52/592.6 |
| 6,571,525 | B2 | | 6/2003 | Coleman | |
| 6,578,338 | B1 | * | 6/2003 | Nanayakkara | 52/606 |
| 6,665,994 | B1 | * | 12/2003 | Ruggeri | 52/592.6 |
| 6,679,022 | B1 | * | 1/2004 | Corporaal | 52/604 |
| 6,763,644 | B1 | * | 7/2004 | Toledo | 52/592.6 |
| 6,907,704 | B2 | | 6/2005 | Abang Ali et al. | |
| 6,996,945 | B2 | | 2/2006 | Doty | |
| 7,168,218 | B2 | * | 1/2007 | Spratlen et al. | 52/604 |
| 7,305,803 | B2 | * | 12/2007 | Correa et al. | 52/604 |
| 7,413,773 | B2 | * | 8/2008 | McCoy et al. | 427/231 |
| 2005/0005556 | A1 | * | 1/2005 | Collier et al. | 52/578 |

* cited by examiner

*Primary Examiner*—Richard E Chilcot, Jr.
*Assistant Examiner*—Alp Akbasli
(74) *Attorney, Agent, or Firm*—Lloyd L. Zickert

(57) ABSTRACT

A mortarless interlocking building block for a building block system comprising a single light-weight block of the standard building block dimensions molded from plastic and configured to be separable into three-quarter, half and one-quarter sizes for accommodating prescribed wall dimension lengths and openings, including a feature for building interconnecting right-angle walls.

23 Claims, 14 Drawing Sheets

MORTARLESS INTERLOCKING BUILDING BLOCK FOR A BUILDING BLOCK SYSTEM

The present invention relates to an improved building block for a mortarless interlocking building block system, and more particularly to an improved block that may be easily sized at construction sites to accommodate wall lengths and openings in walls.

BACKGROUND OF THE INVENTION

Heretofore, it has been well known in building block systems to provide interlocking and mortarless building blocks for load-bearing and non-load-bearing walls such that multiple blocks may be assembled in courses and stacked without the use of mortar.

It has also been known to provide standard building blocks made of plastic for constructing courses and stacks of courses to form a wall or walls. Such blocks have included connecting elements at opposite ends and intermeshing connecting members at the top and bottom faces of the blocks. It has also been known that such blocks have self-aligning features because of male and female connectors, as well as interengaging parts for aligning stacked courses of staggered blocks.

It has been long recognized that use of mortarless interlocking blocks without the need of mortar results in rapid construction of walls even when using unskilled labor.

It has also been known to provide mortarless interlocking products in a system which includes and requires a stretcher block for the erection of a wall, corner blocks for defining the intersection of two walls at right angles, and multiple lengths of blocks for accommodating specified longitudinal dimensional courses of blocks. Further, heretofore it has been known to provide corner blocks of various lengths in order to size a wall along a particular course.

Most heretofore known blocks for mortarless interlocking block systems to produce walls have been costly to produce and in many cases grooves or sockets and protrusions or connectors have been cut into the blocks after they have been molded. Such prior known blocks require additional finishing such as by grinding or cutting to provide connections, and to meet required tolerances. Some heretofore known block systems have also included L-shaped corner blocks in order to erect walls perpendicular to each other.

The improved block of the present invention overcomes the difficulties and problems in heretofore known blocks for block systems by providing a single light-weight block of molded plastic which can easily be cut at the job site to accommodate various course lengths and provide for openings needed for windows and/or doors, as well as eliminating the need to have several types of blocks and various sized blocks to erect a block wall for a building.

SUMMARY OF THE INVENTION

Accordingly, the improved block of the present invention improves the adaptability for erecting a wall of building blocks in a building block system as well as providing the required strength of a wall, and providing the lowest possible cost of erecting such walls. The improved block of the invention is injection molded from a suitable plastic resin such as a urethane or polypropylene and configured so that it can be easily molded and released from the forming mold while preserving full detail and obviating any subsequent reshaping or refinishing before it is to be used. Suitable additives may be included in the plastic resins, such as a UV inhibitor. While the building block of the invention is primarily useful for building external walls of buildings, it should be appreciated that it can be fabricated in various sizes in order to accommodate various requirements for wall constructions including inside walls.

While the improved block of the invention does not require the use of mortar, it will be appreciated that the plastic resin for molding the block would have a zero absorption rate and can optionally be sealed with a silicone sealer during installation to render the cutting wall completely impenetrable by water. The plastic block of the invention includes a plurality of vertically oriented openings and a structure with thin walls to substantially decrease the weight, while not sacrificing strength. Further, the block is constructed to be easily reinforced with rebars and concrete.

Accordingly, it is an object of the present invention to provide a new and improved molded plastic block for use in erecting mortarless building walls with a building block system that reduces the time for erecting the walls and is capable of being used by unskilled laborers.

Another object of the present invention is to provide a self-aligning light-in-weight building block for erecting mortar-free walls of a building without the need to provide corner blocks or blocks of various incremental sizes to produce a building block system for making walls, thereby making it easy to handle by a worker erecting a wall.

A further object of this invention is to provide a building block of one size that can be easily and efficiently cut into three-quarter, half or quarter sizes for accommodating selected dimensional lengths of courses when building a wall.

Another object of the present invention is in the provision of an improved block for building mortarless building block walls wherein the block cost is minimized and wherein the labor time and skill involved is minimized.

A Further object is to provide a light-weight, easy-to-handle building block for making outer or inner walls of a building.

Other objects, features and advantages of the invention will be apparent from the following detailed disclosure, taken in conjunction with the accompanying sheets of drawings, wherein like reference numerals refer to like parts.

DESCRIPTION OF THE INVENTION

The present invention is unique in that it relates to an interlocking building block of the standard building block dimensions, being 12 inches long, 8 inches high and 6 inches wide. The block serves for a building block system to build walls that may be external or internal, such as for a residential home or an industrial building, and is capable of forming corners and openings for doors or windows without the need of providing corner blocks or blocks of other sizes. The block of the invention is of a single size which can easily be cut into three-quarter, half or quarter sizes at the construction site for configuring various wall construction requirements. The block is made of a suitable plastic resin such as urethane or a polypropylene and configured to be easily injection molded such that when it is removed from the mold it is in a finished form and not requiring any finishing operations before being shipped for use. Uniqueness of the design of the block enables it to be easily cut into three-quarter, half and one-quarter sizes while retaining the interlocking features needed to form an interlocking wall. The accurateness of an injection molded block further enables the close fitting together of interlocking blocks in courses and stacks to produce a wall that is substantially impenetrable to water or other liquids while maintaining a high insulating rating against thermoconductivity.

By virtue of providing only a single block configuration for a wall structure, substantial economies in manufacture of the block are accomplished.

Figure 1:
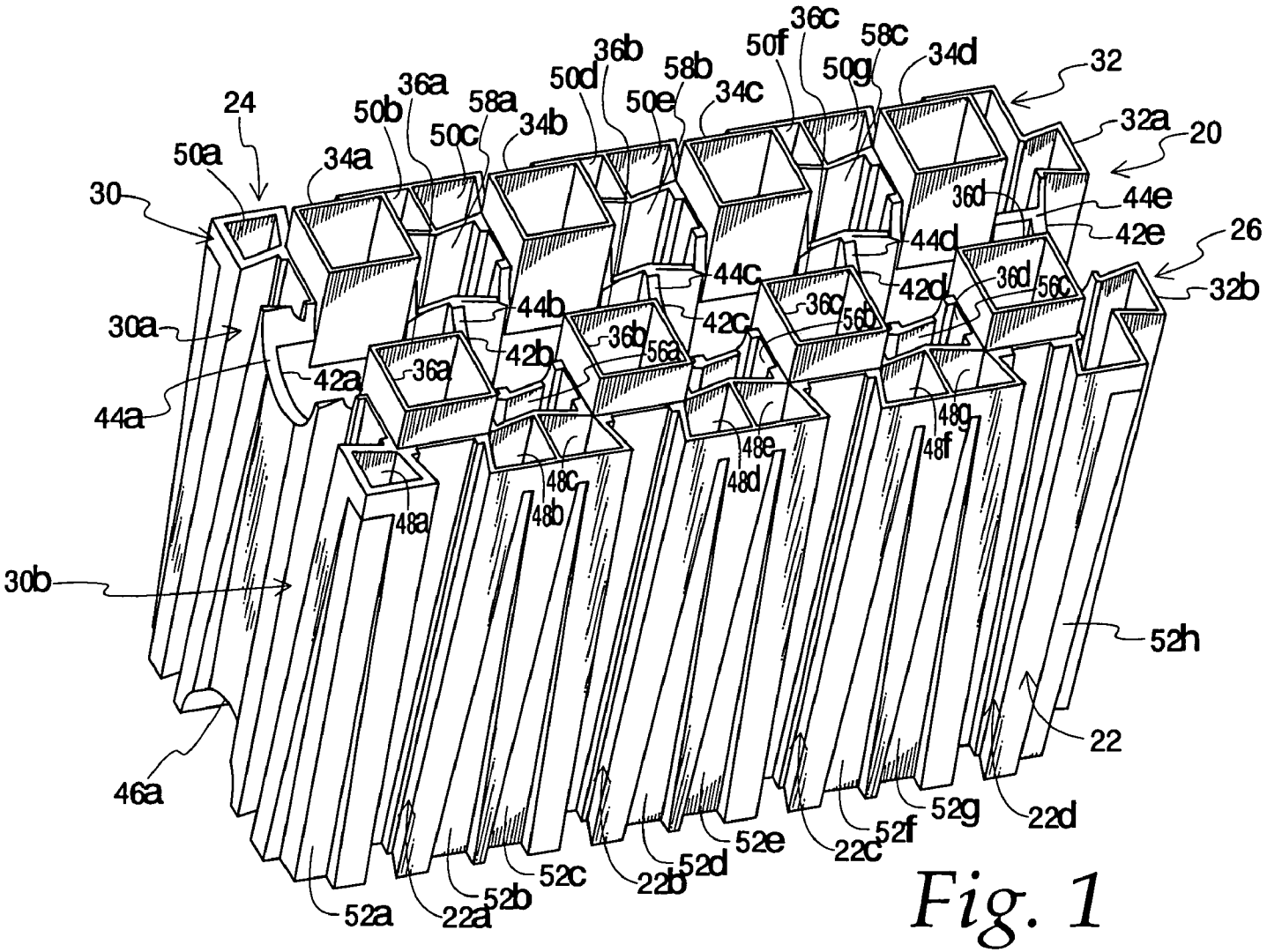
FIG. 1 is a perspective view of the improved block of the present invention looking at the top face of the block and the end having the receptor sockets or female Maltese sockets.
Figure 2:
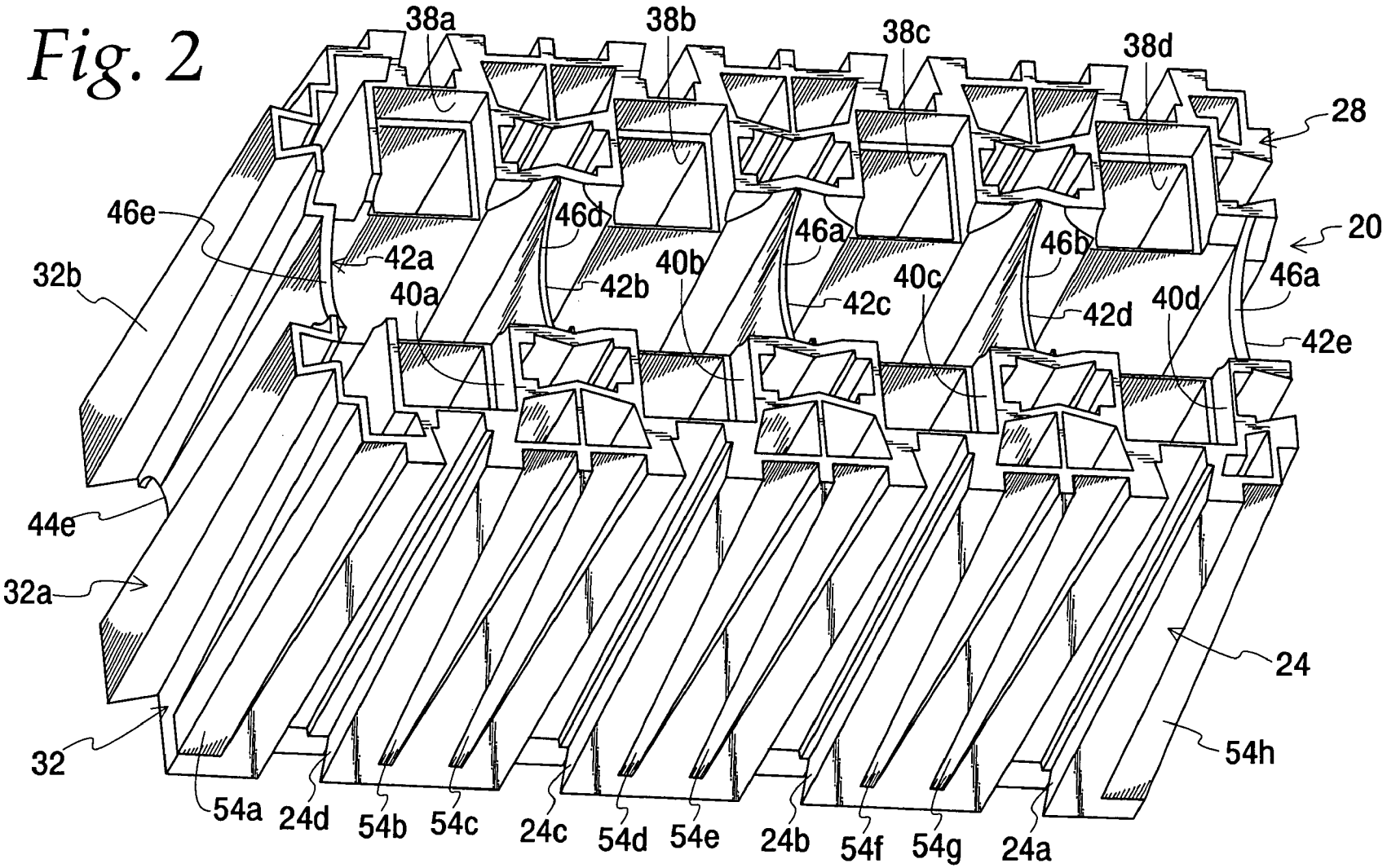
FIG. 2 is a perspective view of the improved block of the invention looking at the bottom of the block and the end of the block having the extrusions or male Maltese protrusions.
Figure 3:
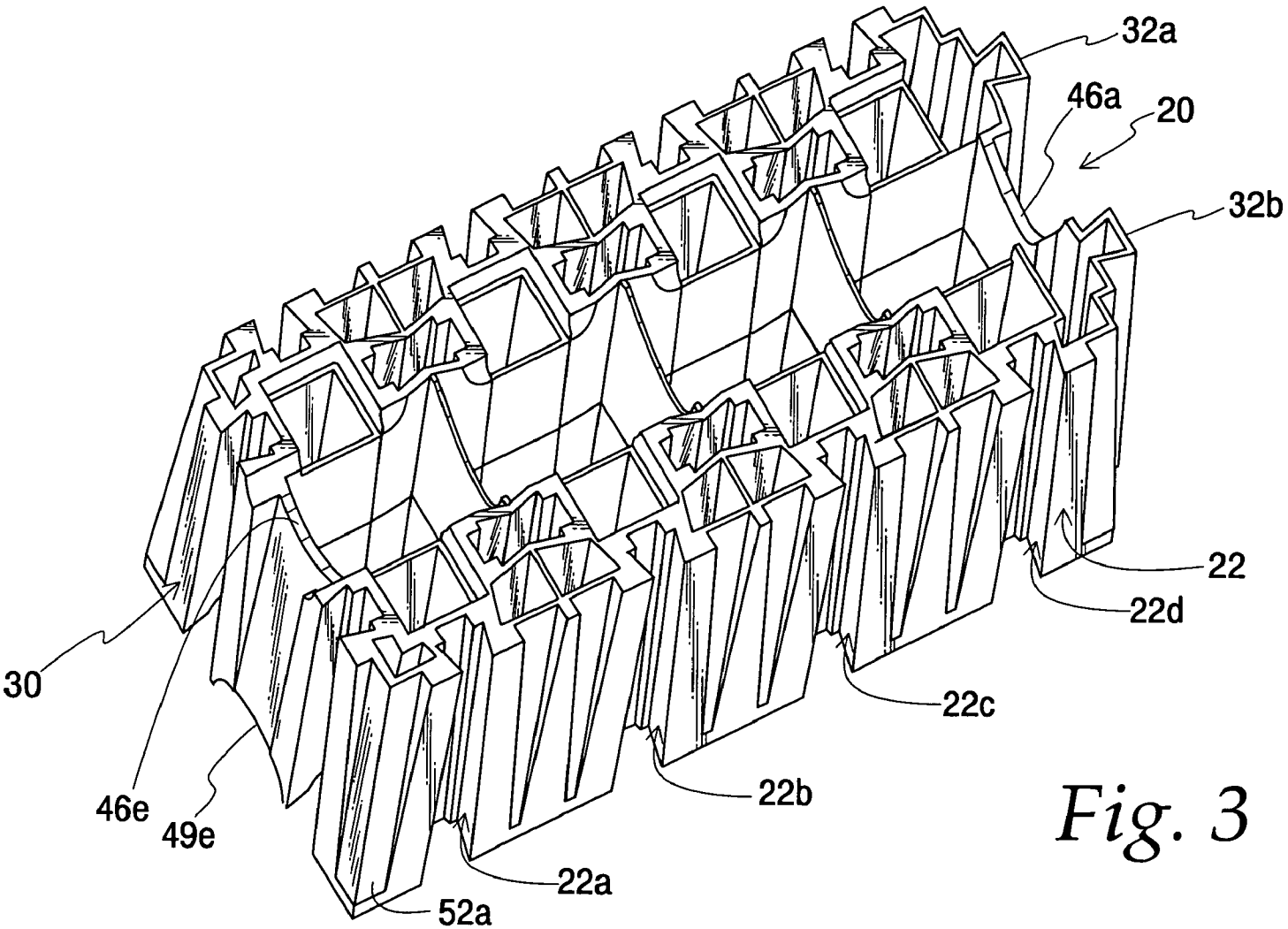
FIG. 3 is a perspective view of the block of the invention taken from the bottom of the block but looking at the opposite end of the block from the view of FIG. 2 and where the receptors or Maltese sockets are located.

Referring now to the drawings, and particularly to FIGS. 1 to 3, the building block of the present invention is generally designated by the numeral 20 and includes parallel opposed front and rear faces 22 and 24, top and bottom parallel faces 26 and 28, and opposed parallel end faces 30 and 32. The opposed front and rear faces 22 and 24 are identical in that each includes vertically extending and equally spaced apart sockets or receptors 22*a*, 22*b*, 22*c* and 22*d* and 24*a*, 24*b*, 24*c* and 24*d*. These sockets are tapered and in diverging relation from the bottom face 28 to the upper face 26. The equally spaced apart relationship of these sockets will be further appreciated, as explained below, where the block may be separated or cut into three-quarter, half or quarter sections.

The opposed end faces 30 and 32 are configured for interlocking with adjacent blocks. The end face 30 is provided with a pair of spaced apart tapered sockets or receptors 30*a* and 30*b* which are identical to the receptors 22*a*, 22*b*, 22*c* and 22*d* and 24*a*, 24*b*, 24*c* and 24*d* on the opposed front and rear walls of the block. Likewise, the receptors 30*a* and 30*b* are tapered in a diverging fashion from the bottom face 28 to the upper face 26. These receptors may also be considered to be female Maltese in cross section sockets or female dovetail sockets as would be the receptors in the opposed front and back faces of the block.

The opposed end face 32 of the block 20 is provided with extrusions or Maltese in cross section male connectors or male dovetail connectors/protrusions 32*a* and 32*b* sized to slide into and fit into under close tolerances with the receptors 30*a* and 30*b* of the face 30, as well as the receptors 22*a*, 22*b*, 22*c* and 22*d* and 24*a*, 24*b*, 24*c* and 24*d* of the front and rear faces of the block. Depending upon the length of the block, whether it be three-quarter, half or quarter, and the need for a wall extending off a main wall of a structure, the extrusions 32*a* and 32*b* may fit into adjacent blocks rather than in a single block.

When placing the building blocks of the present invention to form a wall, the first course is suitably placed on a foundation where suitable guide elements are formed to cause adjacent blocks to be aligned with one another along a straight line. Upwardly jutting guide flanges may be formed in the foundation between which the blocks may be positioned, or any other suitable system may be used to provide suitable alignment of the first course blocks along a desired wall.

Figure 13:
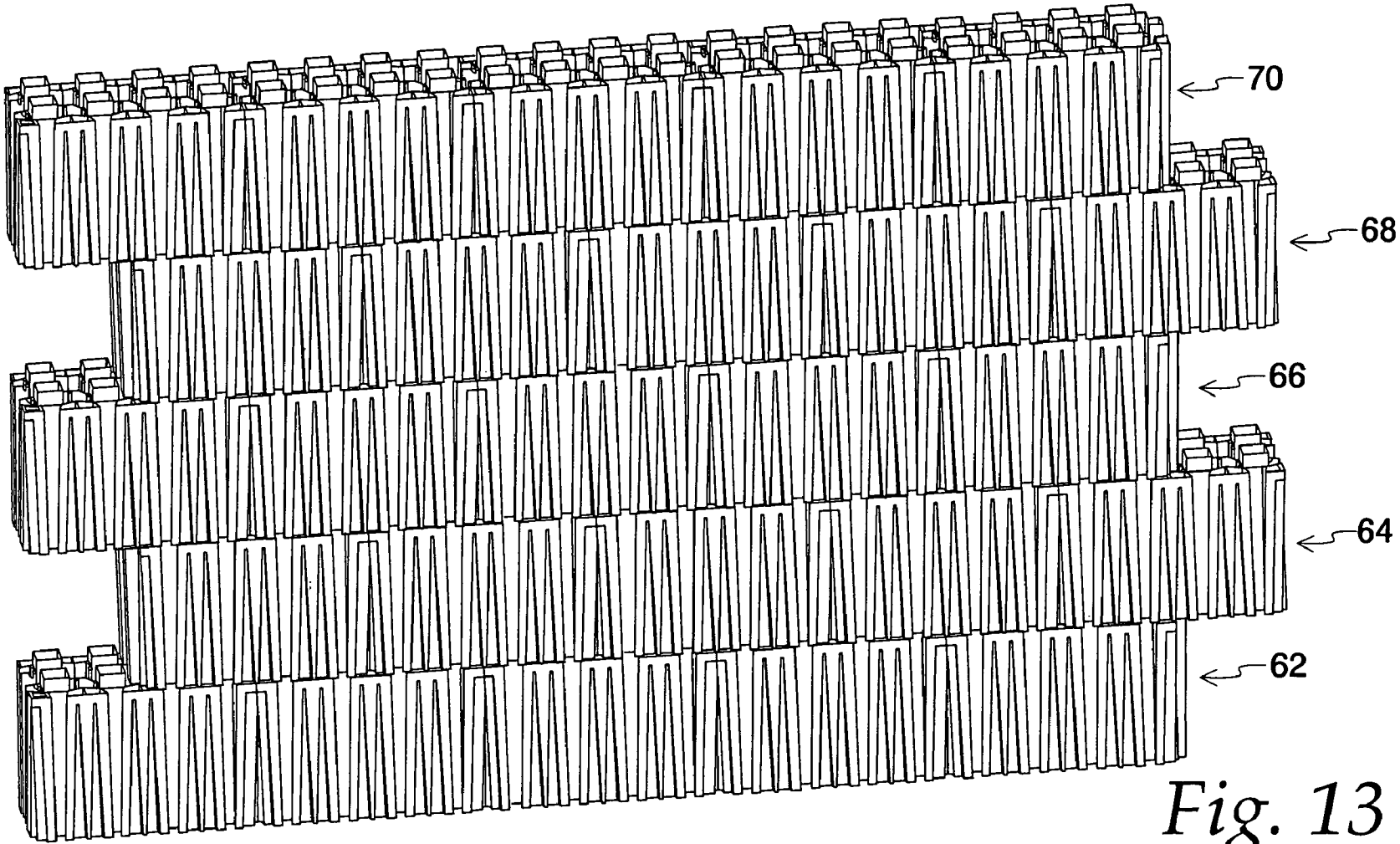
FIG. 13 is a perspective elevational view of a partial wall constructed by a plurality of blocks according to the invention showing a plurality of courses in stacked rows.

Thereafter, a second course of blocks is mounted on the first course such that each block in the second course will be staggered relative to the lower course as generally illustrated in FIG. 13. In order to preclude sliding movement between blocks in adjacent rows, posts are formed on the top face of each block which coact with receptors or sockets formed on the bottom faces of each block. As seen particularly in FIGS. 1 and 2, two rows of posts are formed on each block and designated 34*a*, 34*b*, 34*c* and 34*d* adjacent one vertical face of the block and 36*a*, 36*b*, 36*c* and 36*d* adjacent the opposing vertical face of the block. At the bottom face 28 of each block, two rows of receptors or sockets are provided coacting with the posts, wherein the row of receptors or sockets adjacent the front face of the block are designated 38*a*, 38*b*, 38*c* and 38*d*, while the post receptors adjacent the rear face 24 of the block are designated 40*a*, 40*b*, 40*c* and 40*d*. The post receptors or sockets 38 and 40 are equally spaced apart along the block as are the posts 34 and 36 such that upon placement of a block in an upper row onto blocks in the lower row, the front and back faces of all blocks will align with one another and be in the same plane. The posts 34 and 36 always face upwardly as they are on the top faces of the blocks, while the post sockets or receptors always face downwardly as they are on the bottom faces of the blocks. Moreover, as it will be appreciated that the blocks and adjacent rows are staggered relative to one another, the blocks in the next row up will be covering one-half of each of the blocks on the lower row. As above noted, all of the blocks in the present invention are identical in size, and they may be sectioned three-quarter, half or one-quarter in order to follow the dimensional layout of a wall as to openings for windows and doors. It should also be appreciated that the post receptors or sockets 38 and 40 are essentially three-quarter in size wherein receptors or sockets are open on the inside of the socket, as particularly noted in FIG. 2. This structure enhances the reduction of weight of the block while not impairing the block strength. It is also seen in FIG. 2 that each of the receptors or sockets 38 and 40 includes a ledge or shoulder spaced inwardly from the outer ends of the sockets and generally against which the outer ends of the posts engage once an upper block is properly positioned on lower blocks. This enhances the stability and strength of a wall, although it should be appreciated that inasmuch as each upper block, when placed on lower blocks, engages such that the bottom face of the upper block rests on and fully engages the top face of a lower block. Sufficient tolerances are provided to prevent bottoming of the outer ends of the posts on the shoulders of the post sockets as to preclude any spacing between blocks in adjacent rows.

While the posts and post sockets are cross-sectionally square, it should be appreciated that they may take any suitable polygonal form and as below described with the embodiments of FIGS. 16 and 17, the posts and coacting post sockets may be circular or cylindrical in shape, or any other suitable arcuately formed shape. It will be appreciated that the posts and sockets of the particular building block according to the invention will be compatible with one another and such that they may matingly engage each other to provide the maximum strength values and also to facilitate the laying of the blocks in rows.

As seen particularly in FIGS. 1 and 2, the blocks are formed of integrating thin wall partitions in order to minimize the weight while not sacrificing the strength and requirement for such a building block. While the blocks may be made of any suitable plastic resin, such as urethane or polypropylene, it has been determined that a block made of a polypropylene homopolymer with carbon black as a UV inhibitor is preferred. More particularly, the material for the plastic resin in made of 70 percent calcium filled homopolymer polypropylene with 2 percent carbon black. The 2 percent carbon black serving as a UV inhibitor is adequate to prevent degradation of the plastic from the light prior to being closed in with a suitable outer layer or skin in a finished building structure. Moreover, a block of such a polypropylene will meet the tests established by ASTM of 1900 psi. The block of the invention, when compared to a concrete block, is substantially lighter in weight. A standard concrete building block weighs about 36 pounds, while a standard light-weight concrete block weighs 27 pounds. The block of the invention being only 4 pounds facilitates the handling of the block and the erection of a wall by unskilled laborers, as well as minimizing the cost of manufacture.

The block of the invention can also be further reinforced by the addition of rebars and by filling the blocks with concrete. In order to facilitate the use of rebars in a concrete filling operation, the block of the invention includes five transversely arranged partitions or panels 42*a*, 42*b*, 42*c*, 42*d* and 42*e*. Each of the partitions includes at the upper and lower ends semi-circular cutouts 44 and 46. Thus, the cutouts at the top face of the block are designated 44*a*, 44*b*, 44*c*, 44*d* and 44*e* as seen in FIG. 1, while the cutouts at the bottom face of each block are designated 46*a*, 46*b*, 46*c*, 46*d* and 46*e*. The placement of one row of blocks onto the lower row of blocks therefore defines between those two rows by virtue of the semi-circular cutouts a circular opening extending all along the row of blocks. This circular opening serves to allow the introduction and placement of one or more rebars and concrete throughout the row of blocks wherein the concrete not only embeds the rebar but also fills the interior openings of each of the blocks, thereby greatly enhancing the strength and rigidity of a wall. However, it will be appreciated that it is not necessary to use rebars and concrete in each wall structure. This will depend upon the design requirements of a wall.

Also enhancing the light weight of the block of the invention is the inclusion of spaced apart vertically extending open channels 48 and 50. Particularly as seen in FIG. 1, channels 48*a*, 48*b*, 48*c*, 48*d*, 48*e*, 48*f* and 48*g* are at the front face 22, while channels 50*a*, 50*b*, 50*c*, 50*d*, 50*e*, 50*f* and 50*g* are at the rear face 24 of the block. Further, it will be appreciated that vertical channels are found between vertically extending partitions or panels 42*a*, 42*b*, 42*c*, 42*d* and 42*e*. These vertically extending channels, while not numbered, are readily appreciated by viewing the perspective views of FIGS. 1 and 2 and looking in the areas between the partitions. It will be appreciated that the partitions reinforce the overall structure of the block.

In addition to providing the Maltese-shaped or dovetail-shaped receptors 22*a*, 22*b*, 22*c* and 22*d* on the front face of the block and 24*a*, 24*b*, 24*c* and 24*d* on the rear face of the block, additional cutouts or recesses 52 and 54 are provided on the front and rear faces 22 and 24 respectively of each block. Except for the recesses at the very ends of the block, the recesses are in the shape of the head of an arrow by being wider at the lower end than at the upper end. This also facilitates the tapers needed for the injection molding of the blocks to permit the ease of removal of the block from a mold after it has been formed.

In order for the block of the invention to be sectioned at the job site to provide three-quarter, half and one-quarter lengths, the blocks are molded with two rows of vertically extending channels 56 and 58. Channels 56*a*, 56*b* and 56*c* are provided adjacent the front face 22, while channels 58*a*, 58*b* and 58*c* are provided adjacent the rear face of the block. These channels are in alignment from end to end of the block with the Maltese or dovetail receptors or sockets and Maltese or dovetail connectors on the opposite end faces of the block. The channels 56 align with the socket 30*b* on the end face 30, and the connector 32*b* on the end face 32 of the block. Similarly, the channels 58 adjacent the rear face 24 of the block align with the receptor 30*a* and the connector 32*a* on the opposite end faces of the block.

Figure 4:
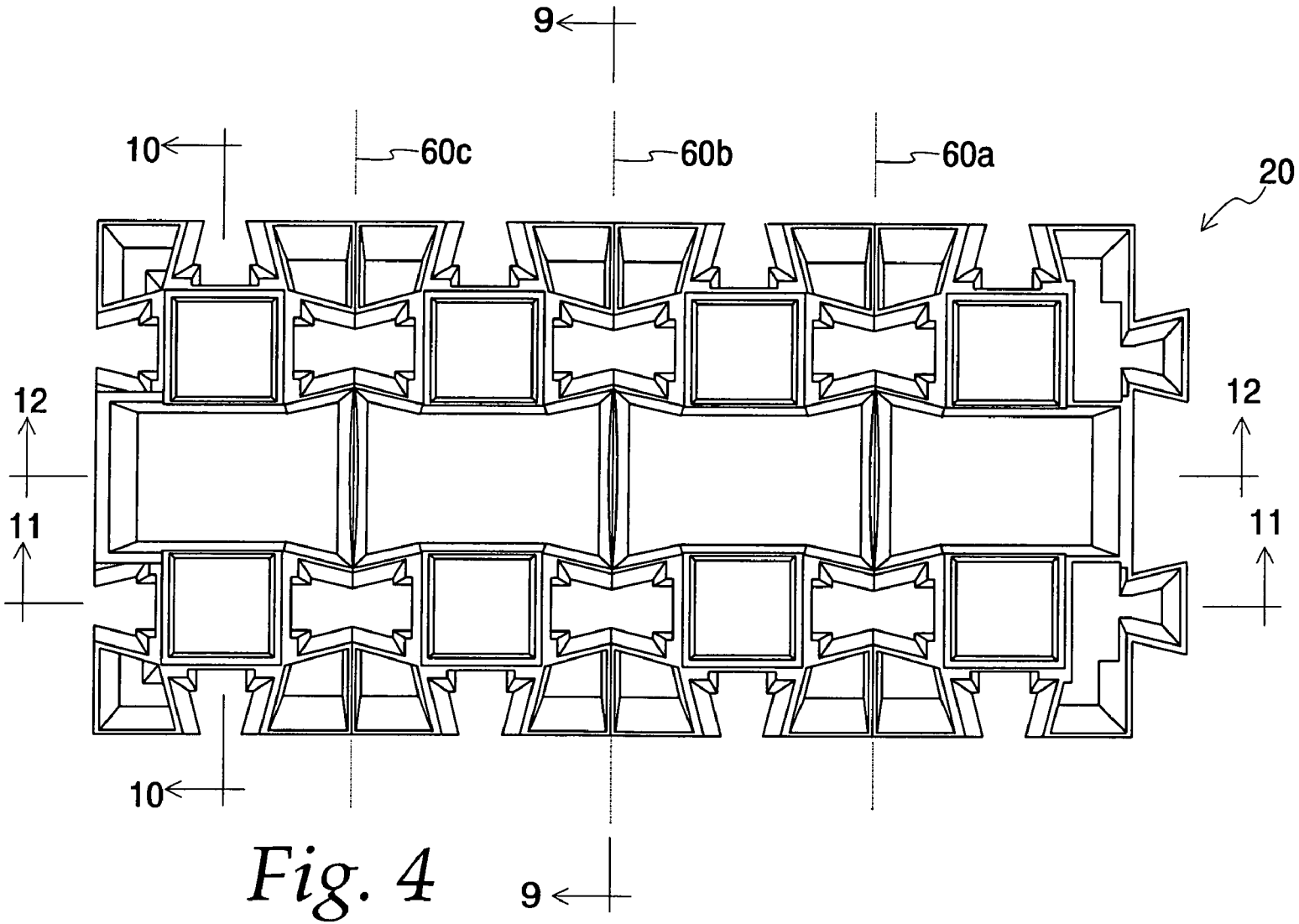
FIG. 4 is a top plan view of the building block of the invention and also showing the cutting planes for cutting the block into three-quarter, half and one-quarter lengths while maintaining the connections on the end faces.
Figure 4B:
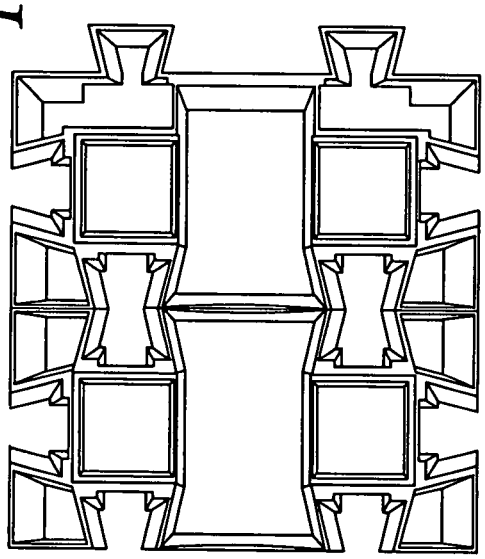
FIG. 4B is a top plan view of a half size block cut from a full size block.
Figure 4A:
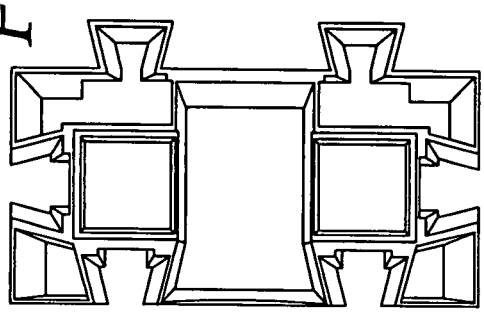
FIG. 4A is a top plan view of a quarter size block cut from a full size block.
Figure 4C:
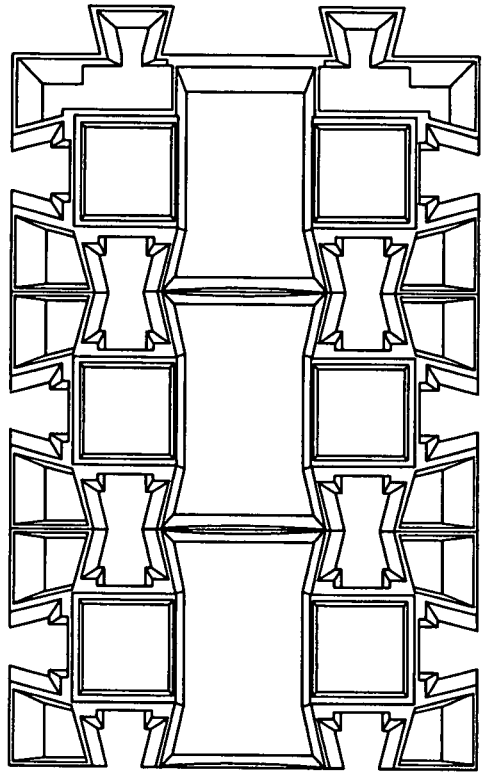
FIG. 4C is a top plan view of a three-quarter size block cut from a full size block.
Figure 5:
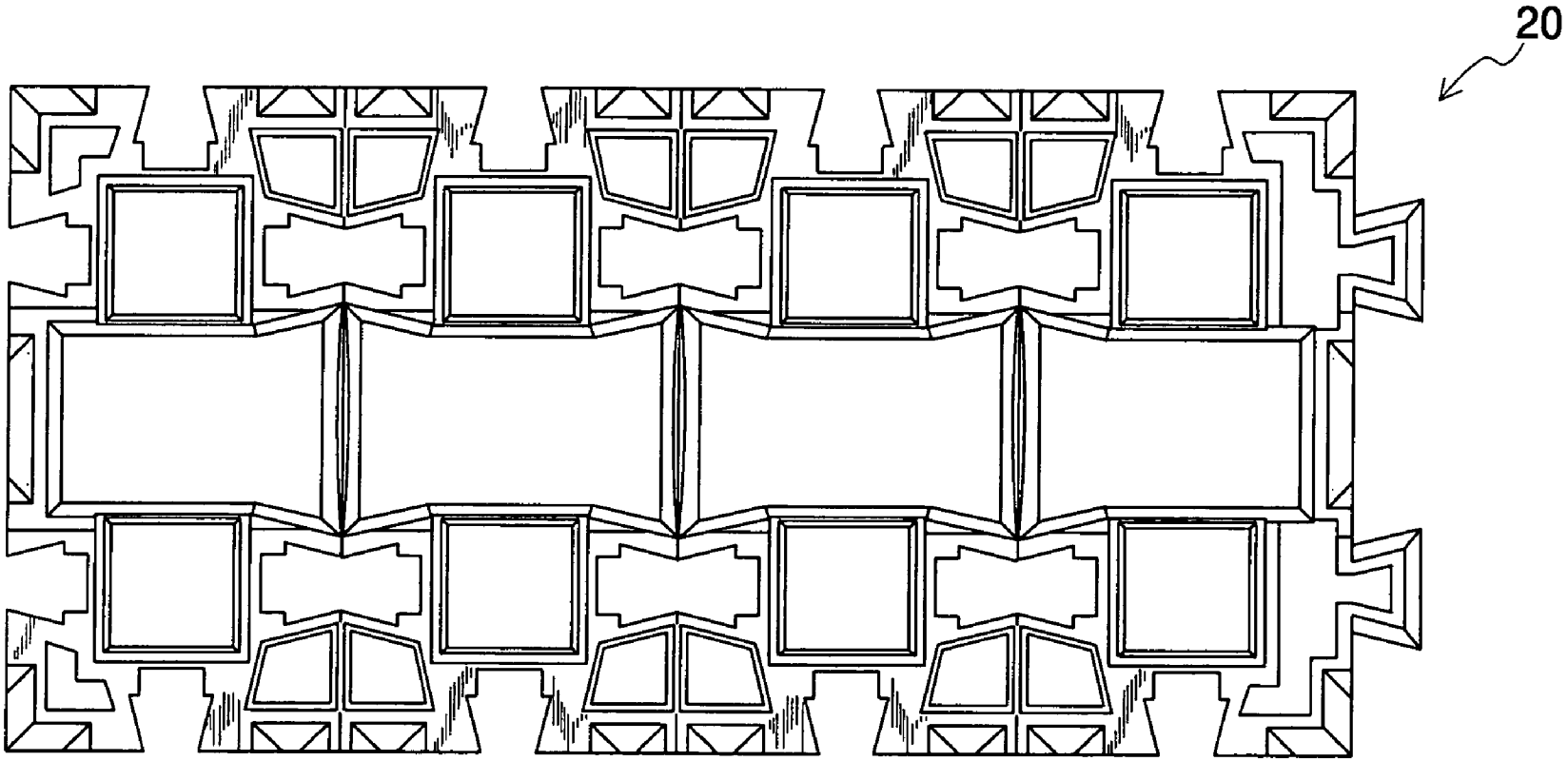
FIG. 5 is a bottom plan view of the block of FIG. 1.
Figure 6:
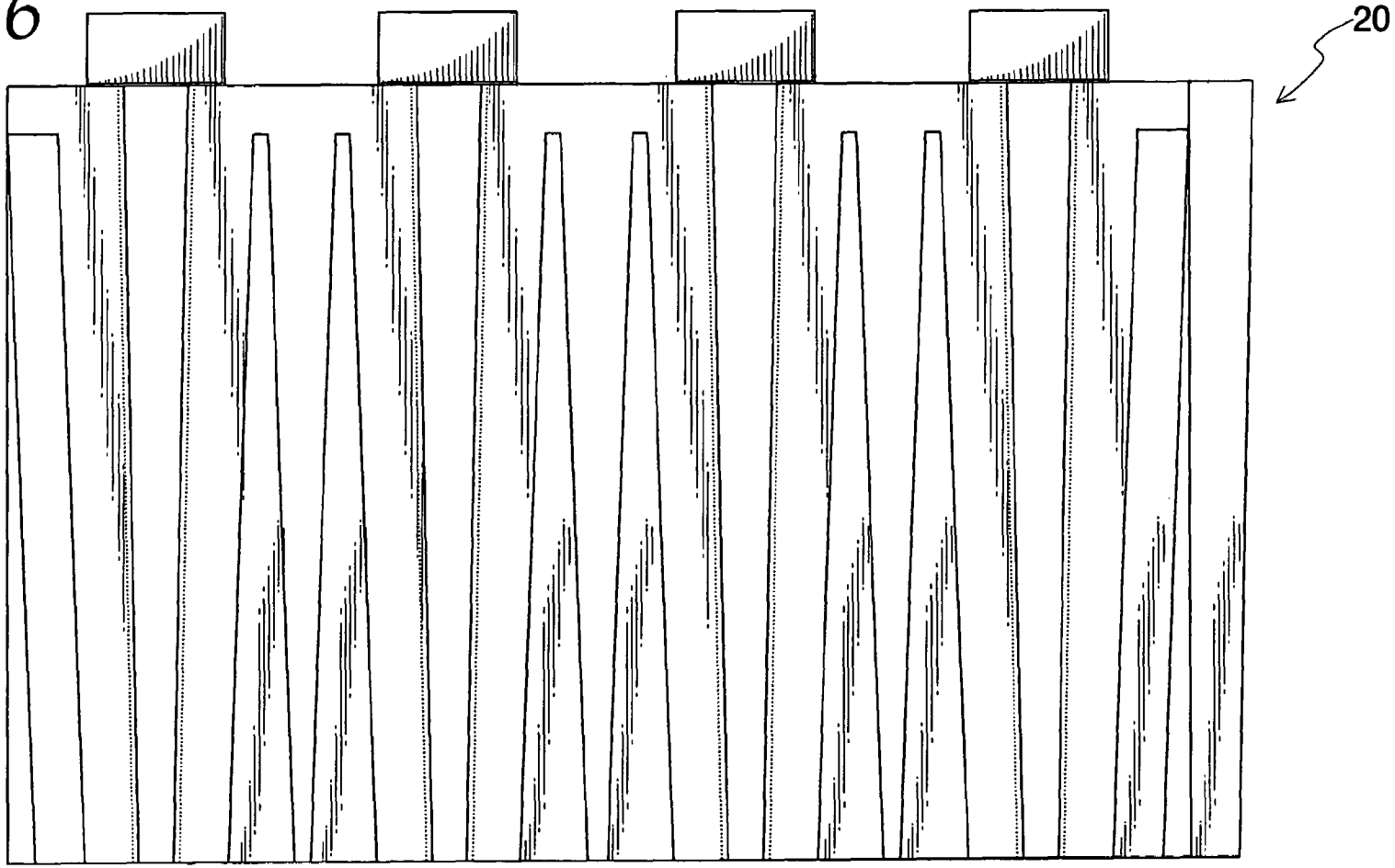
FIG. 6 is a side elevational view of the block of FIG. 1 showing one side and wherein the opposite side is identical as to the configurations of the vertically extending female Maltese sockets or receptors.
Figure 7:
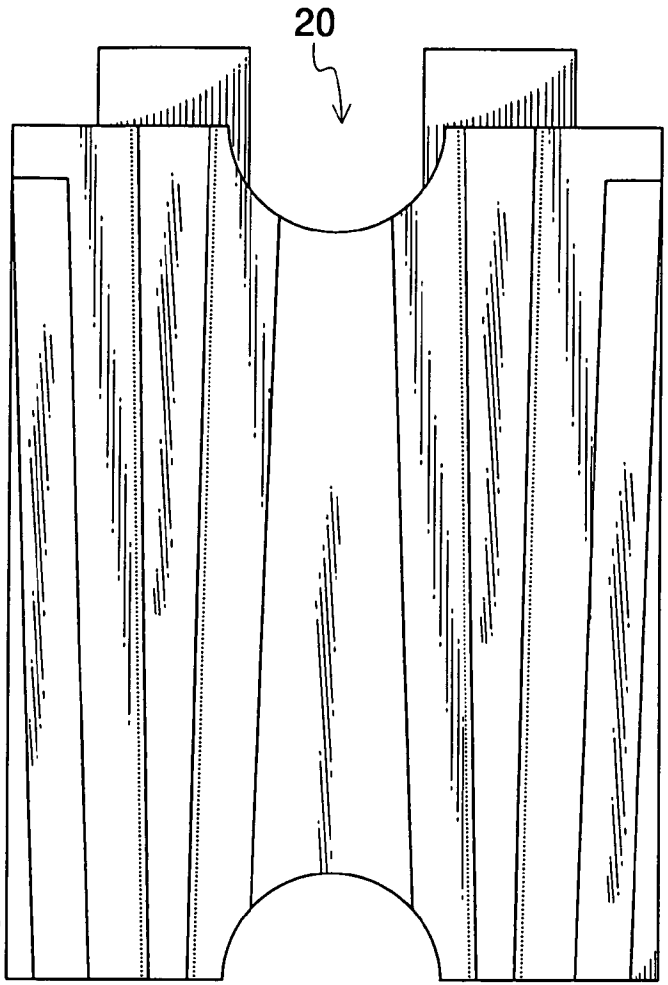
FIG. 7 is an end elevational view of the block of FIG. 1 and looking at the end having the extrusions or male Maltese connectors.
Figure 8:
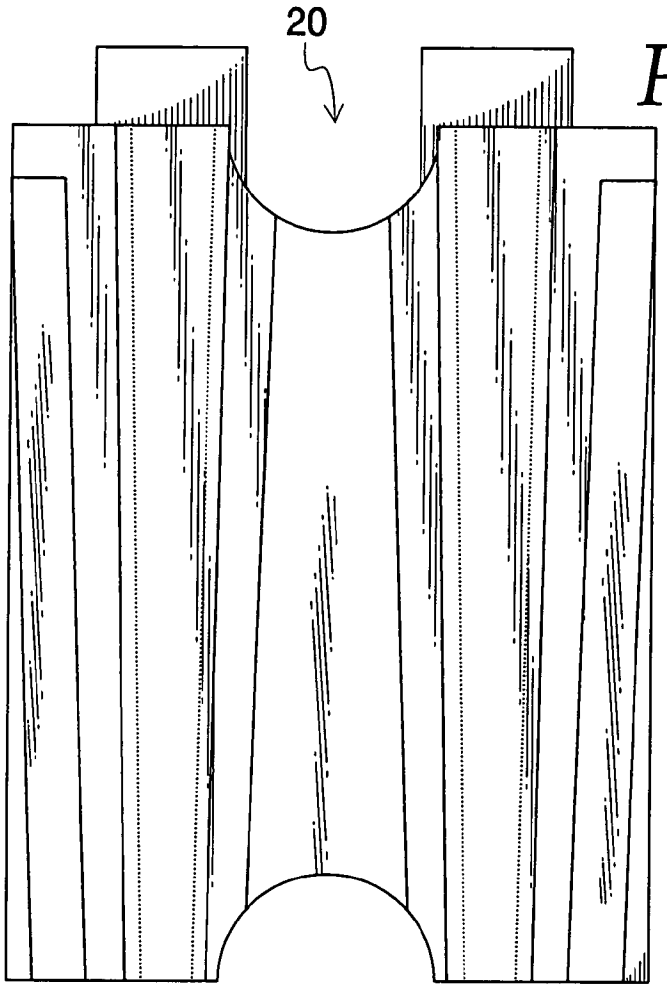
FIG. 8 is an end elevational view of the opposite end of the block of FIG. 1 and the end having the female Maltese sockets or receptors.
Figure 9:
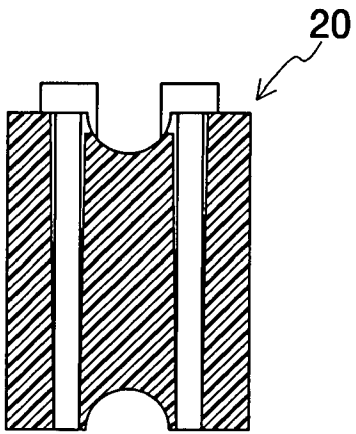
FIG. 9 is a transverse vertical sectional view taken along line 9-9 of FIG. 4.
Figure 10:
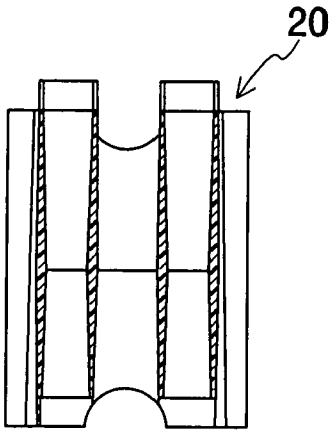
FIG. 10 is a transverse vertical sectional view taken along line 10-10 of FIG. 4.
Figure 11:
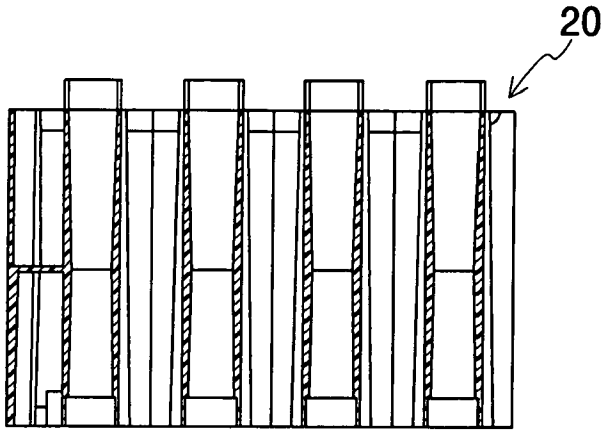
FIG. 11 is a vertical longitudinal sectional view taken along line 11-11 of FIG. 4.
Figure 12:
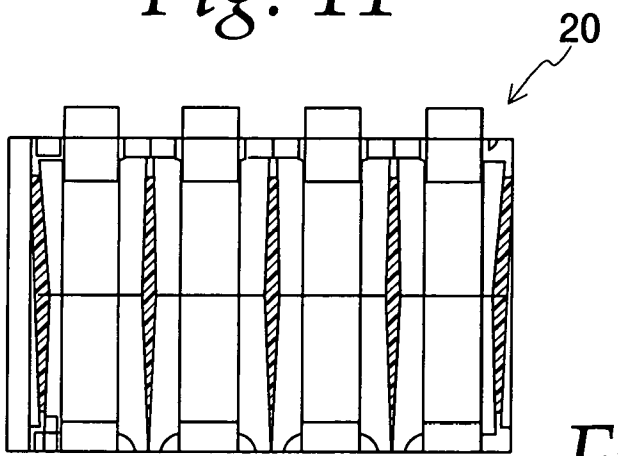
FIG. 12 is a vertical longitudinal sectional view taken along line 12-12 of FIG. 4.

Each of the channels 56 and 58 includes oppositely facing receptors capable of fitting with a connector from Maltese or dovetail-shaped male member. Thus, each channel includes oppositely facing Maltese shaped female members, as particularly illustrated in FIG. 4. FIG. 4 is a top plan view of a block, and with reference to both FIG. 4 as well as FIGS. 4A, 4B and 4C, it can be appreciated that the block of the invention can be sectioned into one-quarter, half or three-quarter lengths in order to satisfy dimensional requirements of a wall structure. As seen in FIG. 4, cutting planes 60*a*, 60*b* and 60*c* respectively allow cutting a block into a quarter length block section as seen in FIG. 4A, a half length block section as seen in FIG. 4B, and a three-quarter length block section as seen in FIG. 4C. The symmetrical columns and formations of the block permit the sectioning of a block into the one-quarter, half and three-quarter lengths in order to accommodate dimensional requirements to form openings for windows and doors as required in a wall structure.

Although the block sections shown in FIGS. 4A, 4B and 4C each include male dovetail protrusions or connectors at one end of the block and female dovetail sockets at the other end of the block, it will be appreciated that in cutting a block along the cutting planes one of the two block sections will include only female dovetail sockets at both ends. These block sections can also be used where the end of the block to which a block section is to be connected includes male dovetail protrusions or connectors. Therefore, the ends of a block to which a block section is to be connected includes either male dovetail connectors or female dovetail sockets. The block section will be cut to provide the desired end face, and in some cases it will be desired that the end of the block not include male dovetail connectors.

Illustrative of the above explanation of block sections cutting the block of FIG. 4 along the cutting plane 60*c* would produce a three-quarter size block having male dovetail connectors at one end and female dovetail sockets at the other end as well as a one-quarter block section having female dovetail sockets at both ends. Cutting the block shown in FIG. 4 along the cutting plane 60*b* would produce a half block having male dovetail connectors at one end and female dovetail sockets at the other end together with a half block having female dovetail sockets at both ends. Cutting the block in FIG. 4 along cutting plane 60*a* would produce a quarter block having male dovetail connectors at one end and female dovetail sockets at the other end together with a three-quarter size block having female dovetail sockets at both ends.

Figure 14:
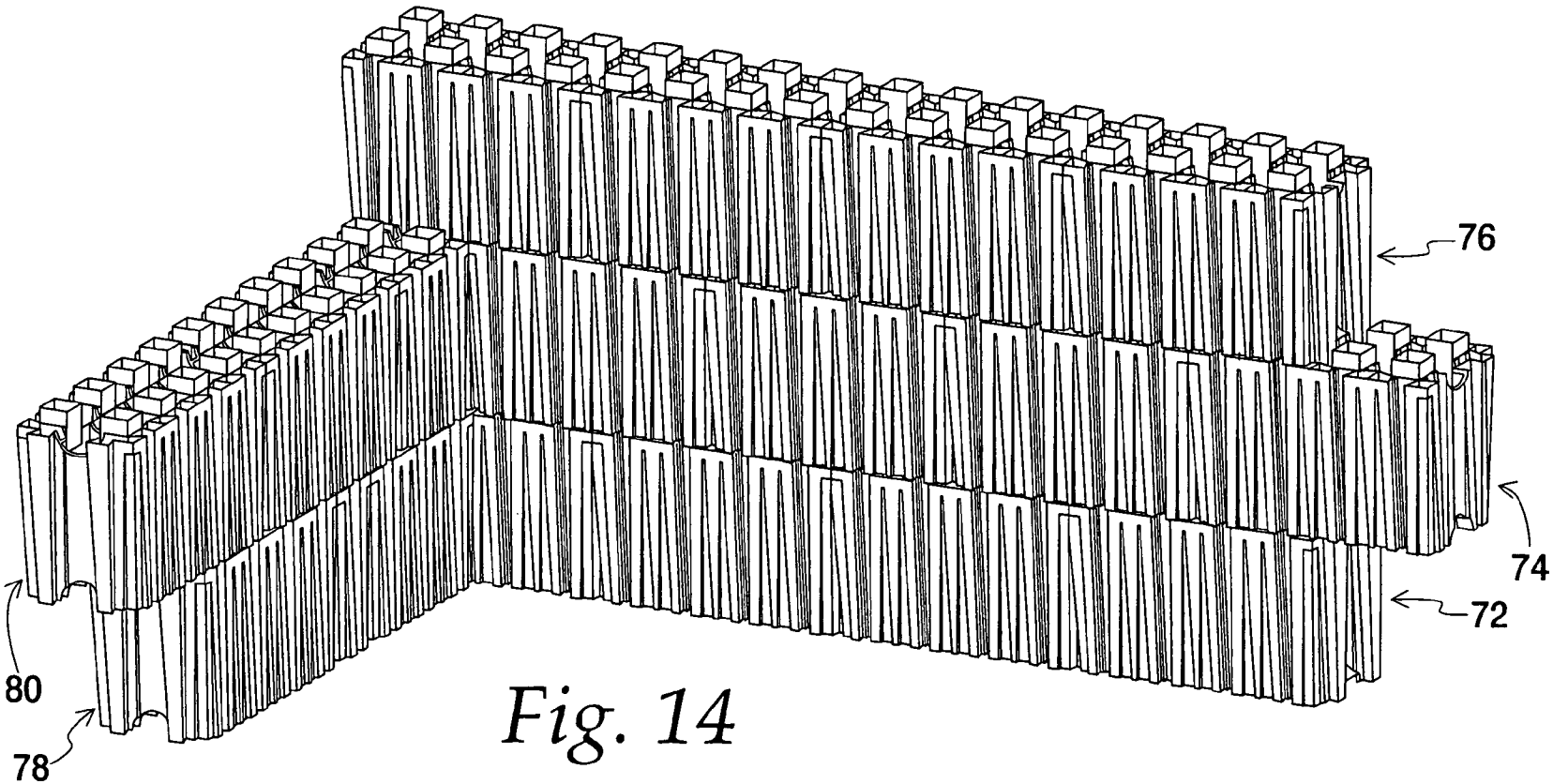
FIG. 14 is a perspective view of an inside corner of a wall constructed of the interlocking mortarless building blocks of the present invention forming a corner.
Figure 15:
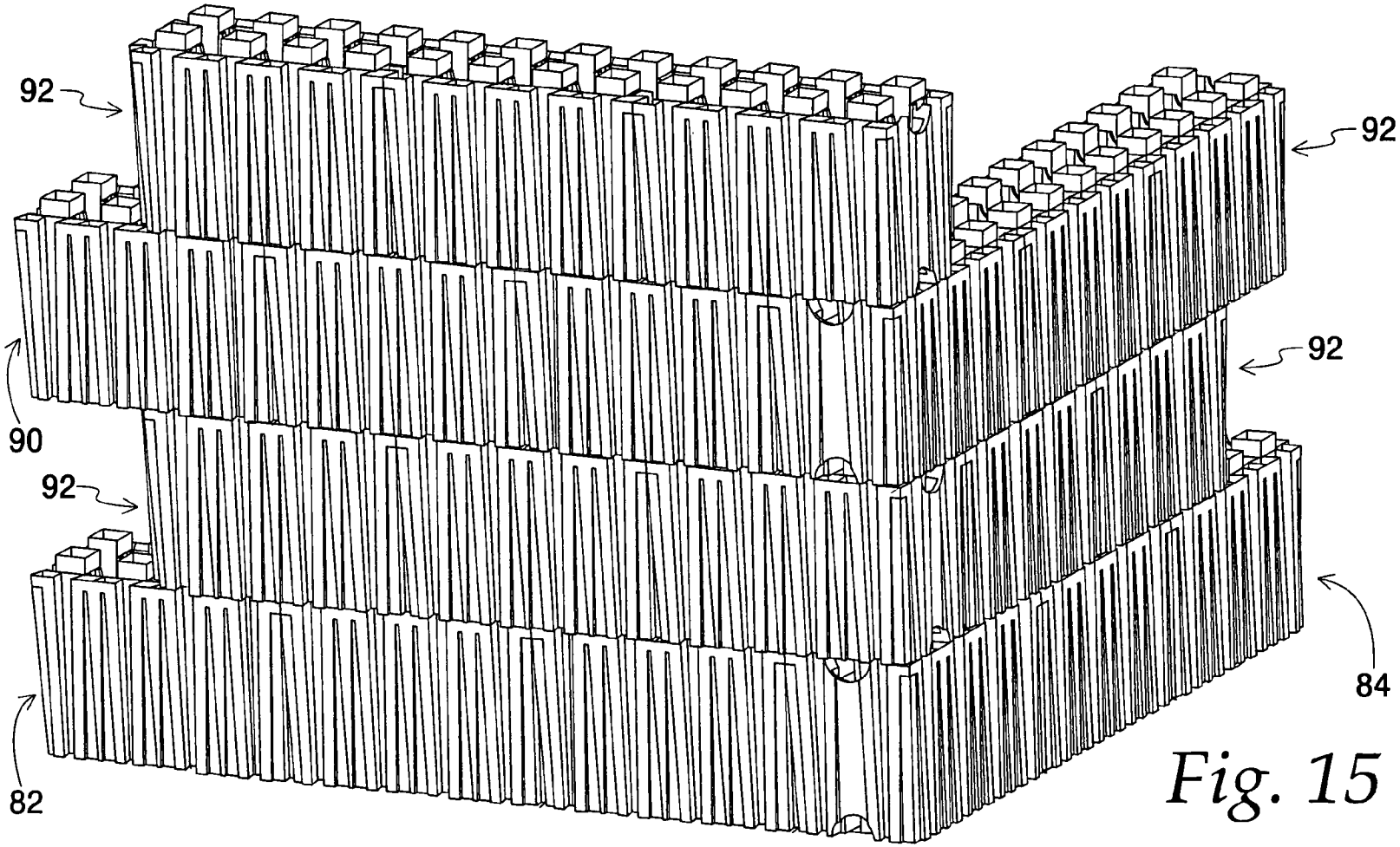
FIG. 15 is a perspective view of the outside corner of a wall shown in FIG. 14.

Referring now to FIGS. 13, 14 and 15, the construction of a wall with blocks according to the present invention is illustrated. As seen in FIG. 13, a wall is constructed with blocks of the present invention with a first course 62 suitably placed on a foundation that is not shown. After the first course has been completed, that includes a plurality of blocks in end-to-end relation, the second course 64 is stacked onto the first course with the blocks in the second course staggered such that each block in the second course that is fully engaged by blocks of the first course would place each block in overlapping relation with two blocks in the first course. In view of the symmetrical shape and placement of components of each block, the first block laid in the second course 64, while preferably overlapping to blocks equally in the first course, could be otherwise placed to overlie three quarters of a block in the first course of one block and only one quarter of an adjacent block. When assembling the first course, it will be appreciated that the male dovetail connectors will be aligned with and inserted into the female dovetail sockets of adjacent blocks to interconnect them together in a close-fitting relationship. Application of the blocks in the second course will include aligning the post receptors of the blocks in the second course with the posts of the blocks in the first course. This process is continued with courses 66, 68 and 70 until the desired height of the wall is reached. Where there would be a desire to have vertically aligned faces of the blocks, block sections would be used to accomplish that end goal.

FIGS. 14 and 15 are illustrations of the inner side of a corner and the outer side of a corner where it is desired to have a corner and blocks to define a wall that is perpendicular to the first wall. In this arrangement, the blocks with male connector ends are interconnected with female dovetail sockets at one side of a block to interconnect the wall at the corner to the main wall of the blocks. In FIG. 14, three courses of stacked blocks are shown on the main wall and designated 72, 74 and 76, while only two courses 78 and 80 are shown on the wall that connects to the main wall for purposes of defining a corner. When making a corner and for the purpose of extending a wall perpendicular to the main wall, it will be appreciated that the wall turning the corner will have the lower course connected prior to beginning the second course 74. Similarly, the course 80 would be in place before beginning the course 76.

The corner wall structure shown in FIG. 15 differs from the wall structure of FIG. 14 in that it shows the outside of the corner and includes one more course of blocks. The main course at the lower end is designated 82 and the side course 84 would be attached to the main course 82 prior to laying the next row of blocks. A second course on the main wall is designated 86, and its side course forming the wall perpendicular to the main wall is designated 88. The course of blocks above the courses 86 and 88 includes the course 90 stacked on the course 86, and the turning course 92 stacked on the course 88. The last course 94 is shown overlapping the side course 92 as well as extending across and on top of the course 90. There will be an alternating placement of blocks such that the end block in the course 84 connects to the male dovetail connectors of the next block in the course 82, while the end block of the course 86 overlaps the last block in the course 84. While the construction of the wall in this embodiment will give the best strength value, it can be appreciated that it can otherwise be set up in view of the symmetrical formation of each block with its posts and post receptors.

Figure 16:
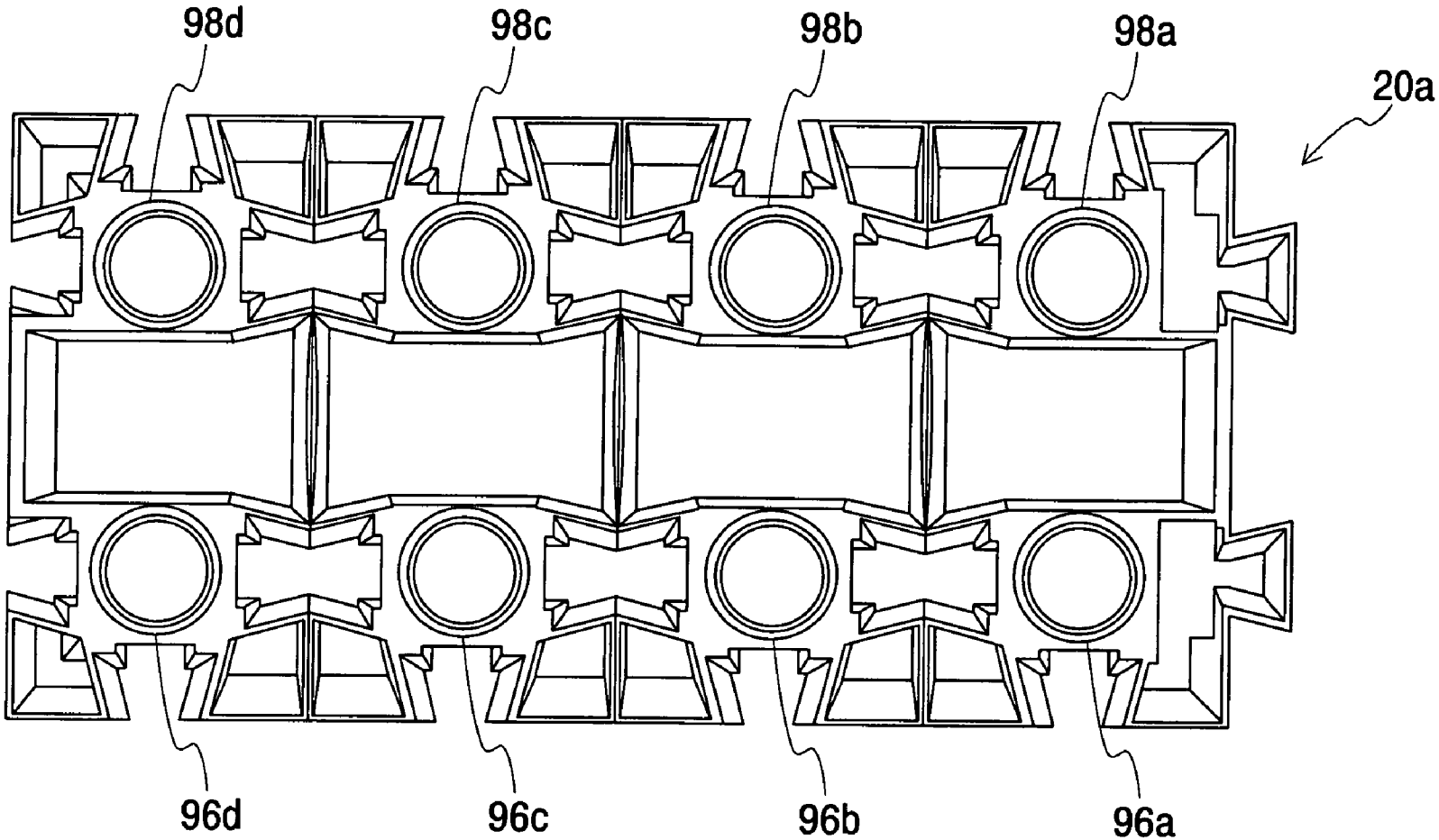
FIG. 16 is a top plan view of a modified building block according to the invention showing the posts on the top face to be cylindrical rather than square.

Referring now to the embodiment of FIG. 16, this block 20*a* differs from the embodiment of FIG. 1 in that the posts employed on the top face of the block are circular or round rather than being square in shape. Otherwise, this embodiment is the same as the embodiment of FIG. 1. The posts are designated in one row as 96*a*, 96*b*, 96*c* and 96*d*, while the posts in the other row are designated 98*a*, 98*b*, 98*c* and 98*d*. Further, the sockets or receptors for receiving the posts will be circular or cylindrical in shape so that there is a close mating relationship between the posts and the sockets between adjacent rows or courses of building blocks. This embodiment also includes the same male dovetail protrusion or connector as well as female dovetail sockets shown in the embodiment of FIGS. 1 to 12.

Figure 17:
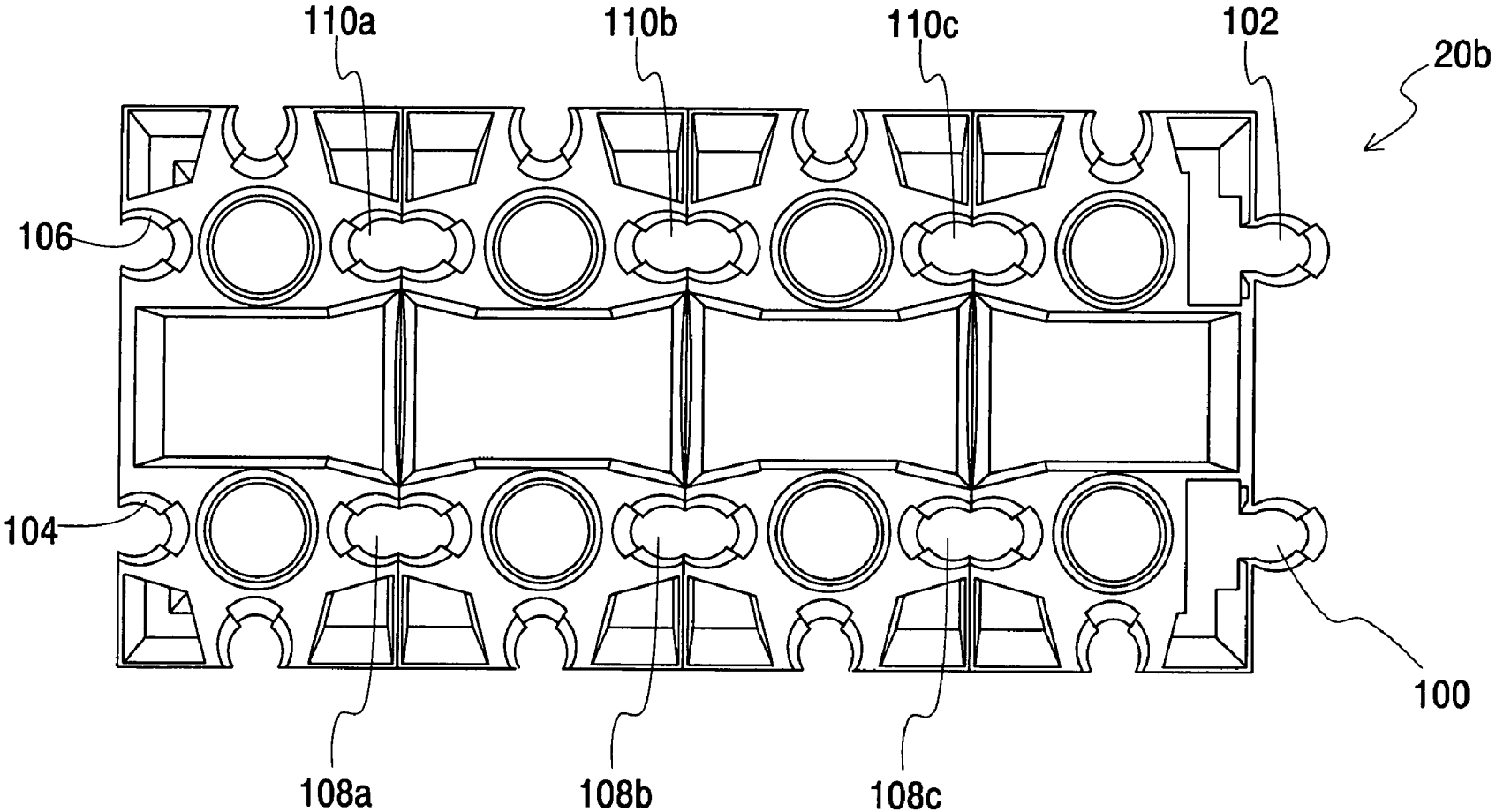
FIG. 17 is a top plan view of a further modified building block according to the present invention having arcuately formed extrusions and receptors on the opposite end faces and also showing cylindrical posts on the top face.

The block 20*b* of FIG. 17 differs from the embodiment of FIG. 16 only in the cross-sectional shape of the connectors at one end of the block and the sockets in the other end of the block. The connectors of this block designated as 100 and 102 are parti-cylindrical in cross section and tapered between ends, thereby providing arcuate faces for engagement with sockets so they would closely receive the connectors. The sockets are designated 104 and 106 and sized to mate with the connectors, and include parti-circular form to coact with the connectors like 100 and 102. Similarly, the sockets provided on the front and back sides of the block would be of the same shape as those at the end face of the block so that they would be compatible with the connectors 100 and 102. Finally, it will be appreciated that the vertical channels designated as 108*a*, 108*b* and 108*c* on one side of the block and 110*a*, 110*b* and 110*c* on the other side of the block are formed such that when cutting the block into shorter block sections they will provide sockets like the sockets 104 and 106 for mating with the connectors 100 and 102. It will be appreciated that other forms of connectors and sockets may be employed so long as the proper connecting relationship can be obtained between adjacent blocks as well as when forming a corner or forming a wall that extends from the middle of another wall as a suitable partition in a building.

It should also be appreciated that once a wall or walls of the building blocks according to the present invention have been erected, they may be covered with a suitable outer sheathing or a brick veneer wall. Where bricks are used, tie-ins can easily be connected between the mortar joints of a brick veneer wall and any of the female sockets along the side of the wall, or the inverted V-shaped recesses.

It will be understood that modifications and variations may be effected without departing from the scope of the novel concepts of the present invention, but it is understood that this application is to be limited only by the scope of the appended claims.

The invention is hereby claimed as follows:

1. In a building block system for constructing walls of a building including a plurality of stacked courses of mortarless interlocking building blocks, the improvement in the building block which comprises:

an injection molded plastic body having a front face, a rear face, opposed top and bottom faces and opposed end faces, one of said opposed end faces having at least one vertically extending tapered socket and the other of said end faces having at least one vertically extending tapered extrusion for mating with said socket to interconnect adjacent blocks in end-to-end relation, said top and bottom faces having a plurality of interengageable mating posts and sockets to lock stacked blocks against slidable movement therebetween, said opposed front and rear faces being substantially identical and including a at least one vertically extending socket for matingly receiving an extrusion of an end face of a block, and a plurality of vertically extending holes in the block body arranged symmetrically such that the weight of the block is greatly reduced.

2. The block of claim 1, wherein one of the end faces include a plurality of sockets and the other a plurality of extrusions.

3. The block of claim 1, wherein one end face includes two spaced apart extrusions, and the other end face includes two spaced apart sockets.

4. The block of claim 1, wherein each of the front and rear faces includes a plurality of sockets.

5. The block of claim 1, which further includes means such that vertically cutting the block in half produces a first block half in size with at least one extrusion on one end face and at least one socket on the other end face, and a second block half in size with at least one socket on each of its end faces.

6. The block of claim 1, which further includes means such that vertically cutting the block at one quarter of its length produces a first one-quarter size block having at least one extrusion on one end face and at least one socket on the other end face, and a second three-quarter size block having at least one socket on each of its end faces.

7. The block of claim 1, which further includes means such that vertically cutting the block at three-quarter of its length produces a first three-quarter size block having at least one extrusion on one end face and at least one socket on the other end face, and a second one-quarter size block having at least one socket on each of its end faces.

8. The block of claim 1, which further includes means such that vertically cutting the block at three-quarter, half, or one-quarter sections respectively produces a first three-quarter, half or one-quarter size block having at least one extrusion on one end face and at least one socket on the other end face, and second one-quarter, half and three-quarter size block having sockets on each of their end faces for use in adjusting the length of a course.

9. The block of claim 1, which further comprises spacing said posts such that the block may be vertically cut into three-quarter, half or one-quarter sections, and means in the block whereby the opposed end faces of one of the sections include at least one vertically extending extrusion and at least one vertically extending socket and the other of said sections includes at least one socket at each of its end faces.

10. The block of claim 1, wherein the posts and sockets of the top and bottom faces are square in cross section.

11. The block of claim 1, wherein the posts and sockets of the top and bottom faces are round in cross section.

12. The block of claim 1, wherein said at least one extrusion and said at least one socket on the end faces and front and rear faces are complementally tapered.

13. A mortarless interlocking building block for constructing walls and/or partitions of a building comprising:

an injection molded plastic body having a front face, a rear face, opposed top and bottom faces and opposed end faces, one of said opposed end faces having at least one vertically extending tapered socket and the other of said end faces having at least one vertically extending tapered extrusion for mating with said socket to interconnect adjacent blocks in end-to-end relation, said top and bottom faces having a plurality of interengageable mating posts and sockets to lock stacked blocks against slidable movement therebetween, said opposed front and rear faces being substantially identical and including a at least one vertically extending socket for matingly receiving an extrusion of an end face of a block, and a plurality of vertically extending holes in the block body arranged symmetrically such that the weight of the block is greatly reduced.

14. The block of claim 13, wherein one of the end faces include a plurality of sockets and the other of the end faces includes a plurality of extrusions.

15. The block of claim 13, which further includes means such that vertically cutting the block into three-quarter, half or one-quarter sections respectively produces a first three-quarter, half or one-quarter size block having at least one extrusion on one end face and at least one socket on the other end face and a second one-quarter, half or three-quarter size block having at least one socket on each of its end faces for use in adjusting the length of one course.

16. The block of claim 13, wherein the mating posts and sockets are polygonal in cross section.

17. The block of claim 13, wherein the mating posts and sockets are square in cross section.

18. The block of claim 13, wherein the mating posts and sockets are round in cross section.

19. The block of claim 13, wherein said vertically extending socket is a female dovetail socket and said mating vertically extending extrusion is a male dovetail protrusion.

20. The block of claim 19, wherein a pair of female dovetail sockets are provided on one end face of the block and a pair of male dovetail protrusions are provided on the other end face of the block.

21. The block of claim 20, wherein said block includes longitudinally spaced apart channels, and each channel cross-sectionally shaped to form a pair of facing female dovetail sockets for mating with a male dovetail protrusion/connector.

22. In a building block system for constructing walls of a building including a plurality of stacked courses of mortarless interlocking building blocks, the improvement in the building block which comprises:

an injection molded plastic body having a front face, a rear face, opposed top and bottom faces and opposed end faces, one of said opposed end faces including a pair of spaced apart vertically extending tapered sockets on one of said end faces and the other of said opposed end faces including a pair of spaced apart vertically extending tapered connectors for mating with said sockets to connect adjacent blocks together, said top face having a pair of rows of longitudinally spaced apart posts and said bottom face having a pair of rows of longitudinally spaced apart sockets complementally formed for engagement by said posts, said opposed front and rear faces being substantially identical and including a plurality of vertically extending sockets of the same configuration as said sockets on an end face to matingly receive connectors of said opposed end face of a block, a plurality of symmetrically arranged vertically extending openings to define a thin walled block of light weight including openings that define opposed tapered sockets such that when cutting a block along a plane into three-quarter, half and one-quarter sizes will define along the cutting plane vertically extending sockets matable with vertically extending connectors.

23. The block of claim 22, wherein the end face sockets are dovetail shaped, and the end face connectors are dovetail shaped.

* * * * *